US005531202A

United States Patent [19]

Lorraine

[11] Patent Number: 5,531,202

[45] Date of Patent: Jul. 2, 1996

[54] FUEL RAIL ASSEMBLY HAVING INTERNAL ELECTRICAL CONNECTORS

[75] Inventor: Jack R. Lorraine, Newport News, Va.

[73] Assignee: Siemens Automotive Corporation, Auburn Hills, Mich.

[21] Appl. No.: 503,783

[22] Filed: Jul. 18, 1995

[51] Int. Cl.[6] ..... F02M 55/02

[52] U.S. Cl. ..... 123/456; 123/533

[58] Field of Search ..... 123/470, 456, 123/468–9, 531, 533

[56] References Cited

U.S. PATENT DOCUMENTS

| | | | |
|---|---|---|---|
| 4,950,171 | 8/1990 | Muzslay | 123/456 |
| 5,086,743 | 2/1992 | Hickey | 123/456 |
| 5,111,794 | 5/1992 | DeGrace Jr. | 123/456 |
| 5,123,399 | 6/1992 | Motoyama et al. | 123/533 |
| 5,131,857 | 7/1992 | Gmelin et al. | 123/456 |
| 5,203,304 | 4/1993 | Hafner et al. | 123/456 |
| 5,209,204 | 5/1993 | Bodenhausen et al. | 123/456 |
| 5,295,468 | 3/1994 | Blessing et al. | 123/456 |
| 5,363,825 | 11/1994 | Becker | 123/456 |

*Primary Examiner*—Thomas N. Moulis
*Attorney, Agent, or Firm*—Russel C. Wells

[57] ABSTRACT

A fuel rail assembly is disclosed with internal electrical connectors for the solenoids of each fuel injector, the fuel injectors having pin contacts inserted into a connector seated in a recess formed in an internal wall of the fuel rail. A common external connector allows the electrical leads from the internal connectors to be connected to an electronic controller. An air assist version features a simplified construction enabled by the internal connectors, and has an air jacket surrounding each fuel injector, with compressed air received from an air supply passage defined within the fuel rail. The internal connectors are located offset from the fuel injector axes to allow an even sealing pressure to be exerted by manifold mounting bolts.

8 Claims, 3 Drawing Sheets

FUEL RAIL ASSEMBLY HAVING INTERNAL ELECTRICAL CONNECTORS

CROSS-REFERENCE TO RELATED APPLICATION

This application is related to copending commonly owned application Ser. No. 08/488,670, filed on Jun. 8, 1995, Attorney Docket No.: 95 P 7676 US.

BACKGROUND OF THE INVENTION

This invention concerns fuel rail assemblies for fuel injected internal combustion engines. Modern engines are usually fuel injected, using one or more fuel rails comprised of hollow tubes, which are supplied with pressurized fuel. A series of fuel injectors are mounted along the fuel rails to be able to receive a flow of fuel from a passage within the fuel rails, the fuel injectors comprising solenoid-operated valves which are opened by electronic switching signals received from an electronic engine controller to cause a volume of fuel to be sprayed into the air intake valve opening of a respective engine cylinder.

The valves are operated by a solenoid, energized by the electronic signals transmitted from the engine controller for predetermined time intervals to inject a proper metered volume of fuel for the various engine operating parameters, all in the manner well known in the art.

The valve solenoids each require electrical connections to be made to the electronic controller.

The most common configuration of fuel injectors is an elongated generally cylindrical body mounted to the fuel rail to extend in a direction transverse to the length of the fuel rail. In so called "top feed" injectors, the top of the injector is seated against a port in the fuel rail to admit fuel into the injector.

In top feed, the entire length of the injector projects from the fuel rail, such that the assembly occupies considerable space. In "bottom feed" injectors developed to alleviate this problem, the fuel rail seat surrounds a substantial portion of the length of the injector to shorten the transverse dimension of the fuel rail assembly.

In both injector configurations, an electrical connector is mounted at an intermediate location along the length of the injector external to the fuel rails, with wire leads extending from each connector to the electronic controller.

In bottom feed injectors, the fuel injector projects above the fuel rail, and an electrical connector is provided at this location. A seal is required at the top and bottom of the injector, to increase the manufacturing costs over the top feed design.

Each connector has two leads, a circuit common lead and a "switch" signal lead over which the switching signal for each individual injector is transmitted. These leads must be hermetically sealed from the atmosphere to prevent corrosion and possible development of a faulty electrical connection which can occur over time if the contacts are exposed to the atmosphere. Each connector body must also be sealed from the fuel cavity.

The external routing of the wires requires a wire harness and a cover for the wire leads.

In U.S. Pat. No. 5,178,115 issued on Jan. 12, 1993 for a "Fuel Rail Assembly Having Self-Contained Electronics," there is described a special injector valve which is mounted entirely within the fuel rail, as are the electrical leads and other circuit components for control of the injector. The injector valve utilizes a magnetic circuit operation rather than a solenoid and is sufficiently compact to be housed entirely within the fuel rail.

The present invention seeks to provide an arrangement for conventionally configured elongated cylinder, solenoid-operated fuel injectors which reduces the seals required both for the injector body and the electrical leads by providing connectors which are located entirely within the fuel passage to be isolated from the atmosphere.

Fuel injectors with "air assist" are also known, in which air is supplied to the injectors, which in turn have passages directing the air flow to an injection port so as to impinge the injected fuel, assisting in breaking up the fuel droplets, In these fuel injectors, an air chamber surrounds the lower end of the injector. The external electrical connector for top feed injectors is interposed between the fuel rail and the air chamber. The air chamber must therefore be sealed at its top and bottom joint with the injector as well as to an air manifold supplying compressed air to each chamber.

It is another object of the present invention to provide an electrical connector for air assisted fuel injectors which simplifies the sealing of the air assist chamber.

SUMMARY OF THE INVENTION

These and other objects of the present invention are achieved by an internal connector which is mounted within the fuel rail to be immersed in fuel and isolated from the atmosphere.

The fuel rail is formed with a series of fuel injector seats formed within tubular projections, each of which receives a generally cylindrical fuel injector, the internal walls of the seats sealed to the fuel injector housing outside diameter. Each fuel injector is held seated within the tubular projection by a retainer element. A connector seat is formed in an opposite wall of the fuel rail aligned and opposite the tubular projection and having an internal electrical connector disposed therein. The top of the fuel injector has a pair of pin contacts upwardly projecting therefrom electrically connected to the solenoid and inserted in socket contacts in a respective internal connector.

Each connector switching lead and the single common lead extend within the fuel rail to a common external connector installed in the fuel rail, and adapted to mate with a connector for connection to the electronic controller.

In an air assist version of the fuel injector according to the present invention, an air pressure manifold is formed integrally with the fuel chamber, and an air supply jacket is installed surrounding the lower end of the injector, which has its upper end received into the fuel rail.

Contact pins extend from the top of the injector and are received in an offset internal connector, previously installed in a recess in the inside of the upper wall of the fuel rail. Electrical leads from the internal connectors extend to a single external connector installed in the fuel rail.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
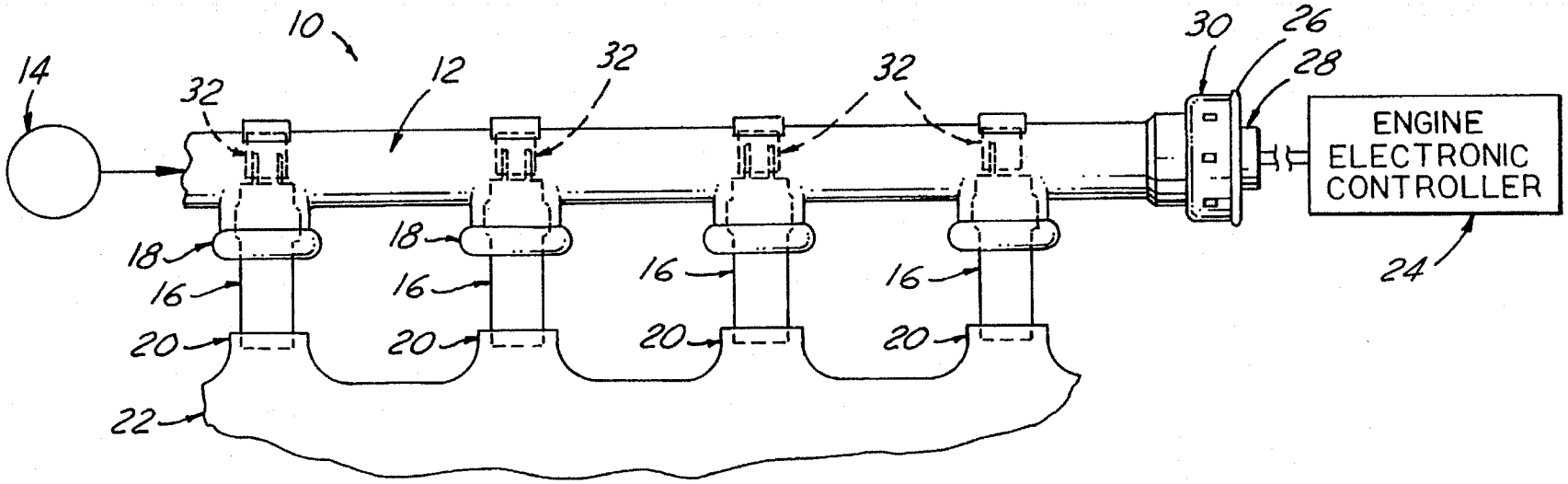
FIG. 1 is a side elevational view of a fuel rail assembly incorporating fuel injectors with internal electrical connectors according to the present invention.

Referring to the drawings and particularly FIG. 1, a fuel rail assembly 10 according to the present invention is shown, which includes an elongated tubular fuel rail 12 defining a fuel passage receiving fuel under pressure from a regulated pressure fuel source 14.

A series of generally cylindrical, elongated fuel injectors 16 each have one end sealingly installed in a respective one of a series of seats 18 distributed along the length of the fuel rail 12, and the opposite end received in a respective one of seats 20 formed in an air manifold 22 of an internal combustion engine. The fuel injectors 16 each have solenoid operated valves operated in response to switching signals generated by an engine electronic controller 24, so as to allow injection of a metered quantity of fuel, in the manner well known in the art.

Figure 2:
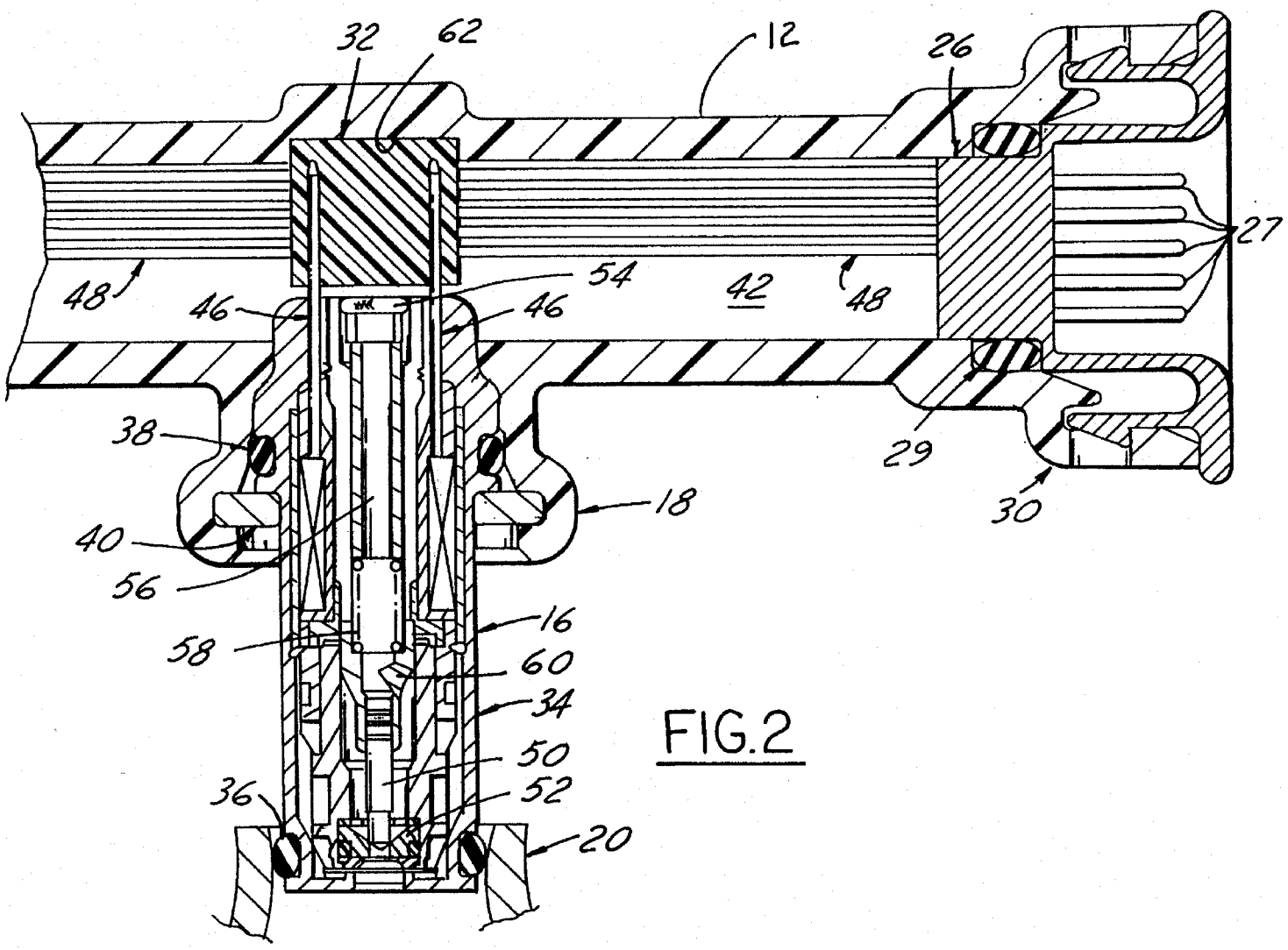
FIG. 2 is an enlarged sectional view taken through the fuel rail assembly shown in FIG. 1.

According to the concept of the present invention, individual connectors 32 for each of the fuel injectors 16 which establish an electrical connection to the controller 24 are located internally within the fuel rail 12. As seen in FIG. 2, a single external connector 26 is provided having pin contacts 27 each connected to a respective one of the leads in a multilead conductor 48 which extend from the individual internal connectors 32. The body of external connector 26 is snap fit to a receptacle 30 formed in the fuel rail 12 and mates with a controller connector 28. The pin contacts 27 are molded into the external connector 26 to be sealed against any escape of fuel. A seal 29 seals against the outside body of external connector 26.

FIG. 2 shows further details of the fuel injectors 16. A tubular housing 34 mounts an O ring seal 36 sealing the lower end of o the injector 16 within the seat 20, and an O ring seal 38 seals the upper end of the fuel injector within the seat 18. A retainer disc 40 snap fit within the seat 18 secures the fuel injector 16 within the seat 18.

The upper end of the fuel injector 16 is thereby held in communication with the internal passage 42 of the fuel rail 12.

The fuel injectors are provided with operator solenoids 44, electrically connected to a pair of pin contacts 46 projecting from the upper end of the injector housing 34, which are inserted into respective socket contacts on the internal connector 32. A multilead conductor 48 extends within the fuel passage 42 and connects each of the contacts of the internal connectors 32 with the contacts of the common external connector 26.

Each fuel injector 16 has a switching contact unique to that connector and a contact which is commonly connected to a single lead in the multilead wire 48.

The electrically insulating portions of the internal connectors 32, the multilead wire 48, and the external connector 26 should be of a material which is resistant to the fuel or fuels to be used.

The fuel injector 16 may otherwise be of conventional construction, including a valve needle 50 moved on and off a valve seat 52 by operation of the solenoid 44. Fuel from the fuel rail internal passage 42 enters the fuel injector 16 through a filter 54, down a central passage 56, through a return spring 58, and through a radial passage 60 reaches the valve seat 52.

The number of seals required are reduced since only the contacts of the single external connector need be sealed against fuel loss, and only the body of that connector needs to be hermetically sealed to the mating plug (not shown).

Each of the internal connectors 32 is seated in a recess 62 aligned with the center of the injector seats 18, 20 so as to be properly located after being roughly positioned by insertion of the multilead wire 48 with the connectors 32 attached.

The fuel injectors are then installed, inserting the pin contacts 46 into the connector 32.

Figure 3:
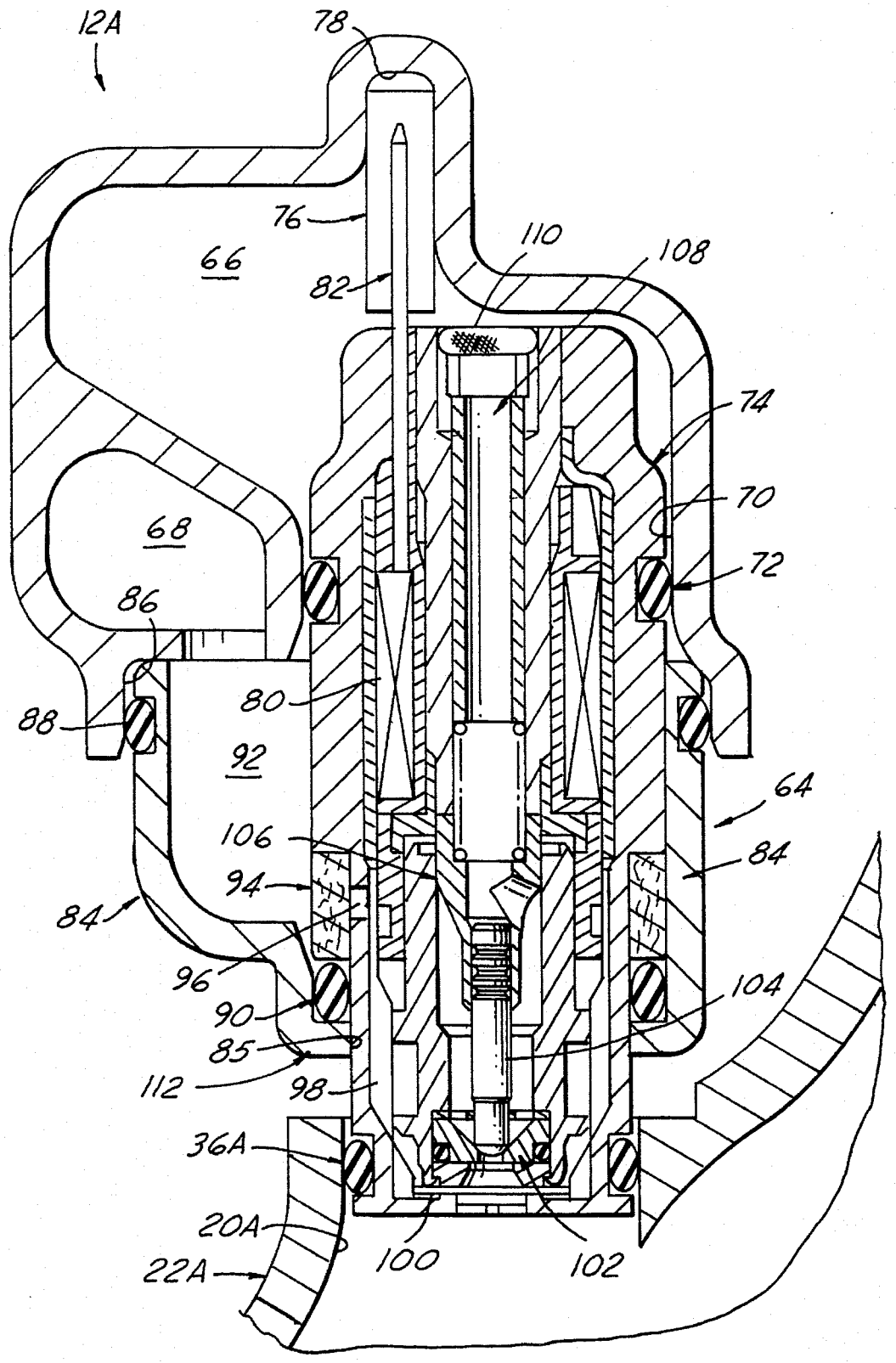
FIG. 3 is an enlarged sectional view taken through an air assist version of the fuel injector with an internal electrical connector.

FIG. 3 illustrates the application to an air assist injector 64. The fuel rail 12A is formed with integral fuel passage 66 and an isolated compressed air passage 68. The fuel injector 64 has its upper end received in a seat 70 entering into the fuel passage 66, an O ring seal 72 installed on the injector housing 74.

The internal connectors 76 are installed in pockets 78 offset from the center axis of the injector 64 to allow a manifold mounting bolt pattern between injectors for even distribution of face seal compression.

The fuel injectors 64 each include an operating solenoid 80 having a pair of pin contacts 82 electrically connected to the solenoid 80 and projecting through the top end of the injector 64, inserted in socket contacts of the respective internal connectors 76.

An air flow jacket 84 is received in a seat 86 open to the air passage 68, and having a seal 88 mounted on the upper end thereof.

The lower end of the air flow jacket 84 has a series of injector seats 85 sealed to the outside diameter of the injector housing 74 with a seal 90.

An air passage 92 is defined within the air flow jacket 84, which communicates air flow through an annular air filter 94 into port 96, thence through an annular space 98 to a radial space 100 to direct air flow into the fuel spray passing through a valve seat 102 to assist in atomization, as well known in the art.

Again, the fuel injectors 64 each received and sealed in a respective seat 20A of the air manifold 22A, the injector 64 otherwise conventional, with a valve needle 104 crimped to a cup 106 which is moved upwardly by an electromagnetic field set up by energizing of solenoid 80 to allow fuel to pass from passage 108 into the air manifold 22A. A fuel filter 110 is installed at the top of the fuel passage 108.

The fuel injectors 64 are each retained in their respective fuel passage seats 70 by a lip 112 formed around each air passage seat.

The sealing necessary is simplified by providing internal connectors, as the air flow jacket 84 can extend directly over the lower end of the associated fuel injector 64.

It is noted that the manifold and fuel rail could be integrated to simplify the bottom feed configuration to be competitive with top feed injectors, as shown in the copending application cross-reference above.

I claim:

1. A fuel rail assembly including an elongated generally tubular fuel rail having an internal fuel passage adapted to receive fuel under pressure, and a series of generally cylindrical fuel injectors installed in said fuel rail distributed along the length thereof;

said fuel rail formed with a series of injector seats each injector seat having a seat opening communicating into the interior of said fuel rail, each injector seat having one end of a respective fuel injector sealingly received therein and retaining means holding said one end of each fuel injector in said injector seat opening;

each of said fuel injectors having an internal passage communicating with said fuel rail internal fuel passage;

said fuel rail having a series of connector seat recesses formed in an interior wall of said internal fuel passage opposite said seat openings, each of said connector seat recesses located opposite a respective seat opening;

an internal electrical connector disposed in each connector seat;

each of said fuel injectors having an electrical solenoid operator and a pair of contacts electrically connected to said solenoid, said contacts mating with corresponding contacts in a respective one of said internal connectors, said fuel injectors each including a valve operated by said electrical solenoid operator to controllably allow outflow of fuel from said injector internal passage;

electrical leads extending from each internal electrical connector to a single external electrical connector installed in said fuel rail to enable connection to an electronic controller for said fuel injectors.

2. The fuel rail assembly according to claim 1 wherein each of said connector seat recesses is aligned opposite a respective injector seat.

3. The fuel rail assembly according to claim 1 wherein each of said injector seats carries an axially fixed retainer disc extending over a feature formed on a respective fuel injector received therein to retain said fuel injector in said injector seat.

4. The fuel rail assembly according to claim 2 wherein each of said internal connectors has socket contacts, and wherein said socket contacts of each of said fuel injectors comprise projecting pin contacts inserted into said socket contacts of said respective internal electrical connector.

5. The fuel rail assembly according to claim 1 further including an air supply passage formed in said fuel rail by an internal wall extending along the length thereof dividing an interior space within said fuel rail into said internal fuel passage and said air supply passage;

said injector seats opening into said internal fuel passage;

an air flow jacket mounted to said fuel rail and open to said air supply passage, said air flow jacket having a series of seats surrounding and sealed to a portion of a respective fuel injector protruding from its associated fuel passage injector seat;

each of said connector seat recesses formed within said internal fuel passage portion of said fuel rail.

6. The fuel rail assembly according to claim 5 wherein said internal connector seat recesses are offset to one side of a respective injector seat opposite one of said connector seat recesses.

7. The fuel rail assembly according to claim 6 wherein said air flow jacket injector seats each have a lip engaging a respective fuel injector to retain the same in one of a respective internal fuel passage injector seats.

8. A fuel rail assembly including an elongated generally tubular fuel rail having an internal fuel passage adapted to receive fuel under pressure, and a series of generally cylindrical fuel injectors installed in said fuel rail distributed along the length thereof;

said fuel rail formed with a series of injector seats each having an opening communicating into the interior of said fuel rail, each injector seat having one end of a respective fuel injector sealingly received therein and retaining means holding said one end of each fuel injector in said injector seat opening;

each of said fuel injectors having an electrical solenoid operator and a pair of solenoid contacts electrically connected to said solenoid;

said solenoid contacts extending into said fuel rail internal fuel passage and mating with corresponding electrical leads extending from each injector to a single external connector installed in said fuel rail to enable connection to an electric controller for said fuel injectors;

an air supply passage formed in said fuel rail by an internal wall extending along the length thereof dividing an interior space within said fuel rail into a fuel supply passage and said air supply passage;

said injector seats opening into said fuel supply passage; and, an air flow jacket mounted to said fuel rail and open to said air supply passage, said air flow jacket having a series of seats surrounding and sealed to a portion of a respective fuel injector protruding from its associated fuel passage injector seat.

* * * * *